US007571625B2

(12) United States Patent
Chang

(10) Patent No.: US 7,571,625 B2
(45) **Date of Patent: *Aug. 11, 2009**

(54) DRUM TYPE WASHING MACHINE

(75) Inventor: Jae-Won Chang, Gunpo (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/475,885

(22) Filed: Jun. 28, 2006

(65) Prior Publication Data

US 2006/0243003 A1 Nov. 2, 2006

Related U.S. Application Data

(63) Continuation of application No. 10/461,451, filed on Jun. 16, 2003.

(30) Foreign Application Priority Data

Dec. 27, 2002 (KR) ..... 10-2002-0085521

(51) Int. Cl.
*D06F 37/22* (2006.01)

(52) U.S. Cl. ..... 68/24; 68/58; 68/140

(58) Field of Classification Search ..... 68/24, 68/58, 140; 134/184, 198
See application file for complete search history.

(56) References Cited

U.S. PATENT DOCUMENTS

| | | | | |
|---|---|---|---|---|
| 912,038 | A | 2/1909 | Seifert | |
| 1,077,043 | A | 10/1913 | Darrow | |
| 1,470,245 | A | 10/1923 | Slider | |
| 1,611,895 | A | 12/1926 | Dienner | |
| 1,787,427 | A | 1/1931 | Eckhard | |
| 2,191,607 | A | 2/1940 | Chamberlin et al. | |
| 2,296,257 | A * | 9/1942 | Breckenridge | 68/24 |
| 2,296,261 | A | 9/1942 | Breckenridge et al. | |
| 2,296,267 | A * | 9/1942 | Baird | 68/24 |
| 2,323,765 | A | 7/1943 | Haberstump | |
| 2,356,818 | A | 8/1944 | Bruckman | |
| 2,389,774 | A | 11/1945 | Haberstump | |
| 2,408,509 | A | 10/1946 | Clark | |
| 2,434,476 | A | 1/1948 | Wales | |

(Continued)

FOREIGN PATENT DOCUMENTS

CN 1332816 A 1/2002

(Continued)

OTHER PUBLICATIONS

European Patent Office 0 405 068 Jan. 1991.*

(Continued)

*Primary Examiner*—Frankie L Stinson
(74) *Attorney, Agent, or Firm*—Birch, Stewart, Kolasch & Birch, LLP

(57) ABSTRACT

Disclosed is a drum type washing machine comprising: a cabinet for forming an appearance; a tub fixed to an inner side of the cabinet and for storing washing water; a drum rotatably arranged in the tub for washing and dehydrating laundry; and a driving motor positioned at a rear side of the drum for generating a driving force by which the drum is rotated. The washing machine can increase washing capacity with maintaining an entire size thereof by increasing a diameter of the drum without increasing a size of the cabinet.

33 Claims, 9 Drawing Sheets

U.S. PATENT DOCUMENTS

| | | | | | |
|---|---|---|---|---|---|
| 2,509,516 | A | | 5/1950 | Murphy | |
| 2,510,836 | A | | 6/1950 | Johnson | |
| 2,526,002 | A | * | 10/1950 | Brotman | 68/140 |
| 2,526,048 | A | * | 10/1950 | Russell | 68/23.1 |
| 2,527,239 | A | | 10/1950 | Woodson | |
| 2,541,166 | A | | 2/1951 | Leef | |
| 2,542,509 | A | | 2/1951 | Goriup | |
| 2,556,490 | A | * | 6/1951 | Chamberlin | 8/159 |
| 2,565,604 | A | | 8/1951 | Geiger | |
| 2,579,472 | A | | 12/1951 | Chamberlin et al. | |
| 2,579,836 | A | | 12/1951 | Lee | |
| 2,656,700 | A | * | 10/1953 | Smith | 68/23.4 |
| 2,717,135 | A | | 9/1955 | Douglas | |
| 2,758,685 | A | | 8/1956 | Sisson | |
| 2,774,621 | A | * | 12/1956 | Kilbourne, Jr. | 277/649 |
| 2,873,599 | A | * | 2/1959 | Buechler | 68/23.1 |
| 2,882,706 | A | | 4/1959 | Brucken | |
| 2,908,871 | A | | 10/1959 | McKay | |
| 2,930,217 | A | | 3/1960 | Rehmke | |
| 2,984,094 | A | | 5/1961 | Belaieff | |
| 2,990,706 | A | | 7/1961 | Bochan | |
| 3,066,522 | A | * | 12/1962 | Steinmuller | 68/23.2 |
| 3,089,326 | A | * | 5/1963 | Belaieff | 68/23.2 |
| 3,098,581 | A | | 7/1963 | Marsilio | |
| 3,178,916 | A | | 4/1965 | Belaieff et al. | |
| 3,197,983 | A | | 8/1965 | Ilmer | |
| 3,206,267 | A | | 9/1965 | Gruner et al. | |
| 3,273,361 | A | | 9/1966 | Smith | |
| 3,356,222 | A | | 12/1967 | Belaeff | |
| 3,389,881 | A | | 6/1968 | Stelwagen | |
| 3,391,469 | A | | 7/1968 | Reeder | |
| 3,459,461 | A | * | 8/1969 | Bannon, Jr. | 312/257.1 |
| 3,477,259 | A | | 11/1969 | Barnish et al. | |
| 3,509,742 | A | | 5/1970 | Bauer | |
| 3,531,954 | A | * | 10/1970 | Krupsky | 68/18 F |
| 3,927,542 | A | | 12/1975 | de Hedouville et al. | |
| 4,114,406 | A | | 9/1978 | Horowitz et al. | |
| 4,295,387 | A | | 10/1981 | Zhivotov et al. | |
| 4,412,390 | A | | 11/1983 | Grant | |
| 4,446,706 | A | | 5/1984 | Hartwig et al. | |
| 4,498,181 | A | | 2/1985 | Menown et al. | |
| 4,618,193 | A | | 10/1986 | Cuthbert et al. | |
| 4,989,684 | A | | 2/1991 | Conaway | |
| 5,038,586 | A | * | 8/1991 | Nukaga et al. | 68/12.01 |
| 5,080,204 | A | | 1/1992 | Bauer et al. | |
| 5,199,690 | A | | 4/1993 | Marshall | |
| 5,209,458 | A | | 5/1993 | Eubank et al. | |
| 5,230,229 | A | | 7/1993 | Stadelmann et al. | |
| 5,267,456 | A | | 12/1993 | Nukaga et al. | |
| 5,526,657 | A | | 6/1996 | Johnson | |
| 5,657,649 | A | | 8/1997 | Lim et al. | |
| 5,711,170 | A | * | 1/1998 | Johnson | 68/3 R |
| 5,711,171 | A | | 1/1998 | Uhlin et al. | |
| 5,768,730 | A | | 6/1998 | Matsumoto et al. | |
| 5,870,905 | A | | 2/1999 | Imamura et al. | |
| 5,961,105 | A | | 10/1999 | Ehrnsberger et al. | |
| 5,979,195 | A | | 11/1999 | Bestell et al. | |
| 6,032,494 | A | | 3/2000 | Tanigawa et al. | |
| 6,122,843 | A | | 9/2000 | Noguchi et al. | |
| 6,148,647 | A | | 11/2000 | Kabeya et al. | |
| 6,343,492 | B1 | | 2/2002 | Seagar et al. | |
| 6,363,756 | B1 | | 4/2002 | Seagar et al. | |
| 6,474,114 | B1 | | 11/2002 | Ito et al. | |
| 6,477,867 | B1 | | 11/2002 | Collecutt et al. | |
| 6,481,035 | B2 | | 11/2002 | Seagar et al. | |
| 6,510,715 | B1 | | 1/2003 | Simsek et al. | |
| 6,510,716 | B1 | | 1/2003 | Kim et al. | |
| 6,539,753 | B1 | * | 4/2003 | Ito et al. | 68/3 R |
| 6,557,383 | B1 | * | 5/2003 | Ito et al. | 68/23.2 |
| 6,578,391 | B2 | | 6/2003 | Seagar et al. | |
| 6,626,014 | B2 | | 9/2003 | Heyder et al. | |
| 6,981,395 | B2 | | 1/2006 | Ryu et al. | |
| 2003/0056302 | A1 | | 3/2003 | Broker et al. | |
| 2004/0031295 | A1 | | 2/2004 | Choi | |
| 2004/0035155 | A1 | | 2/2004 | Yoon | |
| 2004/0244121 | A1 | | 12/2004 | Lim et al. | |
| 2004/0244168 | A1 | | 12/2004 | Lee | |

FOREIGN PATENT DOCUMENTS

| | | | | |
|---|---|---|---|---|
| DE | 1912481 | | | 3/1965 |
| DE | 24 01 888 | | | 7/1975 |
| DE | 24 54 489 | | * | 5/1976 |
| DE | 26 33 604 | | * | 2/1978 |
| DE | 26-33-604 | A1 | | 2/1978 |
| DE | 27 32 684 | | | 2/1978 |
| DE | 31 09 641 | A1 | | 2/1982 |
| DE | 31 34633 | A1 | | 8/1982 |
| DE | 34 37 835 | A1 | | 5/1985 |
| DE | 39 34 434 | A1 | | 4/1991 |
| EP | 0124939 | B1 | | 11/1984 |
| EP | 0 132 805 | | | 2/1985 |
| EP | 0272949 | B1 | | 6/1988 |
| EP | 0 371 926 | | | 6/1990 |
| EP | 0 405 068 | A1 | | 1/1991 |
| EP | 0-750-064 | A1 | | 12/1996 |
| EP | 0 969 134 | A1 | | 1/2000 |
| EP | 1 055 765 | A1 | | 11/2000 |
| EP | 1 688 531 | A1 | | 8/2006 |
| GB | 2 096 649 | A | | 10/1982 |
| GB | 2 157 326 | A | | 10/1985 |
| GB | 2 202 867 | | * | 10/1988 |
| GB | 2202867 | A | | 10/1988 |
| JP | 48-64179 | | | 8/1973 |
| JP | 56-116987 | A | | 9/1981 |
| JP | 57-43792 | A | | 3/1982 |
| JP | 10-201993 | | * | 8/1988 |
| JP | 3-88479 | U | | 9/1991 |
| JP | 3-88479 | U | | 9/1991 |
| JP | 4-92697 | | | 3/1992 |
| JP | 04-240488 | | | 8/1992 |
| JP | 4-371194 | | | 12/1992 |
| JP | 09-182370 | A | | 7/1997 |
| JP | 09-182370 | A | | 7/1997 |
| JP | 11-76680 | A2 | | 3/1999 |
| JP | 2002-346281 | A | | 12/2002 |
| KR | 2004-0058999 | | | 7/2004 |
| SU | 1663074 | A1 | | 7/1991 |
| WO | WO 98/29595 | | | 7/1998 |

OTHER PUBLICATIONS

European Patent Office 0 124 939 Nov. 1984.*
Euorpean Patent Office 1 272 949 Jun. 1988.*
European Patent Office 0 405 068 Jun. 1989.*

* cited by examiner

DRUM TYPE WASHING MACHINE

This is a Continuation of application Ser. No. 10/461,451, filed Jun. 16, 2003, currently pending, which claims the priority under 35 U.S.C. § 119(a) on patent application Ser. No. 10-2002-0085521 filed in Korea on Dec. 27, 2002, which is herein incorporated by reference.

BACKGROUND OF THE INVENTION

1. Field of the Invention

The present invention relates to a drum type washing machine, and more particularly, to a drum type washing machine which can maximize a capacity of a drum without changing an entire size of a washing machine.

2. Description of the Related Art

FIG. 1 is a side sectional view showing a drum type washing machine in accordance with the conventional art, FIG. 2 is a front sectional view showing the drum type washing machine in accordance with the conventional art.

The conventional drum type washing machine comprises: a cabinet 102 for forming an appearance; a tub 104 arranged in the cabinet 102 for storing washing water; a drum 106 rotatably arranged in the tub 104 for washing and dehydrating laundry; and a driving motor 110 positioned at a rear side of the tub 104 and connected to the drum 106 by a driving shaft 108 thus for rotating the drum 106.

An inlet 112 for inputting or outputting the laundry is formed at the front side of the cabinet 102, and a door for opening and closing the inlet is formed at the front side of the inlet 112.

The tub 104 of a cylindrical shape is provided with an opening 116 at the front side thereof thus to be connected to the inlet 112 of the cabinet 102, and a balance weight 118 for maintaining a balance of the tub 104 and reducing vibration are respectively formed at both sides of the tub 104.

Herein, a diameter of the tub 104 is installed to be less than a width of the cabinet 102 by approximately 30~40 mm with consideration of a maximum vibration amount thereof so as to prevent from being contacted to the cabinet 102 at the time of the dehydration.

The drum 106 is a cylindrical shape of which one side is opened so that the laundry can be inputted, and has a diameter installed to be less than that of the tub 104 by approximately 15~20 mm in order to prevent interference with the tub 104 since the drum is rotated in the tub 104.

A plurality of supporting springs 120 are installed between the upper portion of the tub 104 and the upper inner wall of the cabinet 102, and a plurality of dampers 122 are installed between the lower portion of the tub 104 and the lower inner wall of the cabinet 102, thereby supporting the tub 104 with buffering.

A gasket 124 is formed between the inlet 112 of the cabinet 102 and the opening 116 of the tub 104 so as to prevent washing water stored in the tub 104 from being leaked to a space between the tub 104 and the cabinet 102. Also, a supporting plate 126 for mounting the driving motor 110 is installed at the rear side of the tub 104.

The driving motor 110 is fixed to a rear surface of the supporting plate 126, and the driving shaft 108 of the driving motor 110 is fixed to a lower surface of the drum 106, thereby generating a driving force by which the drum 106 is rotated.

In the conventional drum type washing machine, the diameter of the tub 104 is installed to be less than the width of the cabinet 102 with consideration of the maximum vibration amount so as to prevent from being contacted to the cabinet 102, and the diameter of drum 106 is also installed to be less than that of the tub 104 in order to prevent interference with the tub 104 since the drum is rotated in the tub 104. According to this, so as to increase the diameter of the drum 106 which determines a washing capacity, a size of the cabinet 102 has to be increased.

Also, since the gasket 124 for preventing washing water from being leaked is installed between the inlet 112 of the cabinet 102 and the opening 116 of the tub 104, a length of the drum 106 is decreased as the installed length of the gasket 124. According to this, it was difficult to increase the capacity of the drum 106.

SUMMARY OF THE INVENTION

Therefore, an object of the present invention is to provide a drum type washing machine which can increase a washing capacity without changing an entire size thereof, in which a cabinet and a tub is formed integrally and thus a diameter of a drum can be increased without increasing a size of the cabinet.

Another object of the present invention is to provide a drum type washing machine which can increase a washing capacity by increasing a length of a drum without increasing a length of a cabinet, in which the cabinet and a tub are formed integrally and thus a location of a gasket is changed.

To achieve these and other advantages and in accordance with the purpose of the present invention, as embodied and broadly described herein, there is provided a drum type washing machine comprising: a cabinet for forming an appearance; a tub fixed to an inner side of the cabinet and for storing washing water; a drum rotatably arranged in the tub for washing and dehydrating laundry; and a driving motor positioned at the rear side of the drum for generating a driving force by which the drum is rotated.

The tub is a cylindrical shape, and a front surface thereof is fixed to a front inner wall of the cabinet.

Both sides of the tub are fixed to both sides inner wall of the cabinet.

A supporting plate for mounting the driving motor is located at the rear side of the tub, and a gasket hermetically connects the supporting plate and the rear side of the tub, in which the gasket is formed as a bellows and has one side fixed to the rear side of the tub and another side fixed to an outer circumference surface of the supporting plate.

A supporting unit for supporting an assembly composed of the drum, the driving motor, and the supporting plate with buffering is installed between the supporting plate and the cabinet.

The supporting unit comprises: a plurality of upper supporting rods connected to an upper side of the supporting plate towards an orthogonal direction and having a predetermined length; buffering springs connected between the upper supporting rods and an upper inner wall of the cabinet for buffering; a plurality of lower supporting rods connected to a lower side of the supporting plate towards an orthogonal direction and having a predetermined length; and dampers connected between the lower supporting rods and a lower inner wall of the cabinet for absorbing vibration.

The drum is provided with a liquid balancer at a circumference of an inlet thereof for maintaining a balance when the drum is rotated.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
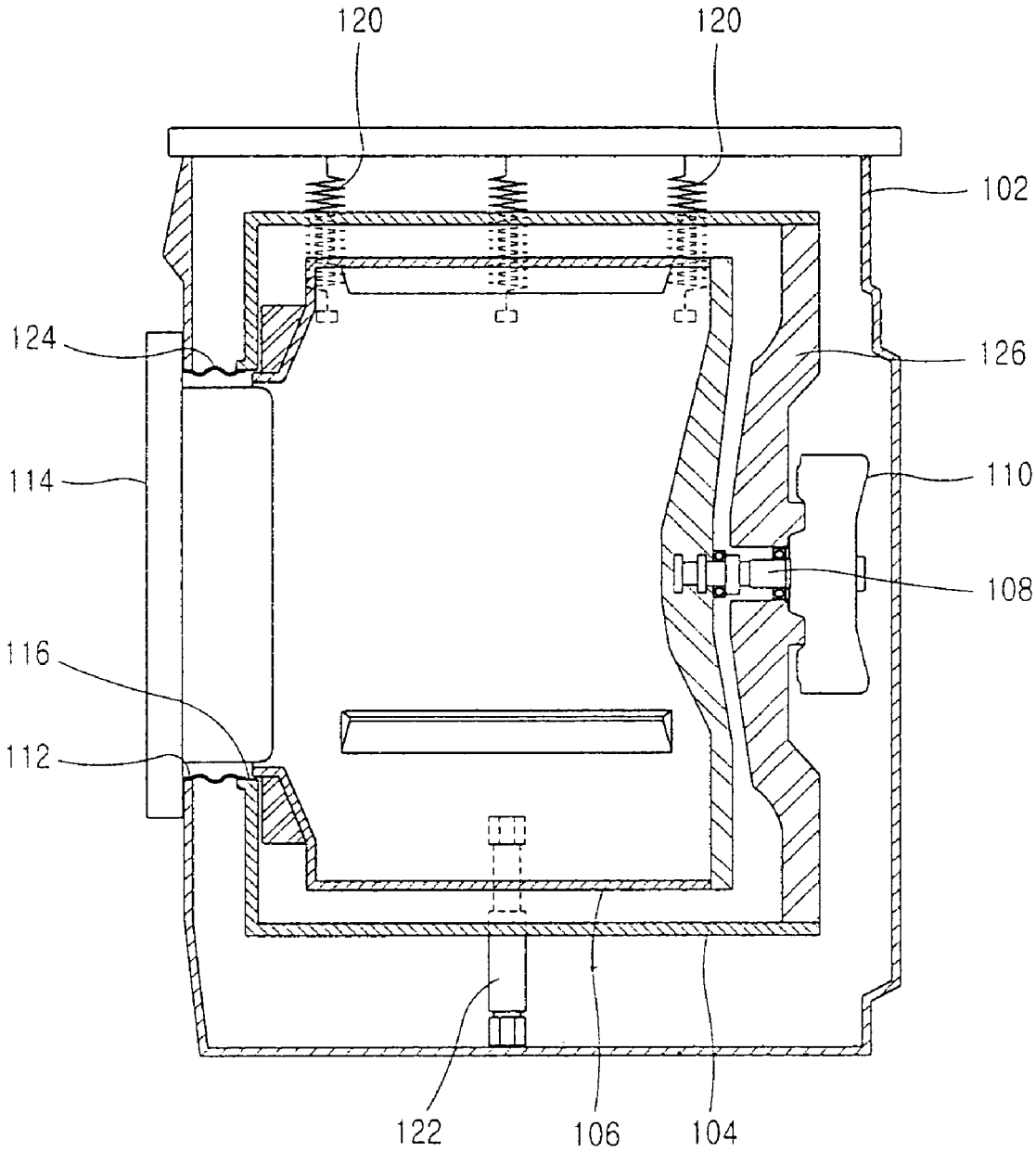
FIG. 1 CONVENTIONAL ART
FIG. 1 is a side sectional view showing a drum type washing machine in accordance with the conventional art.
Figure 2:
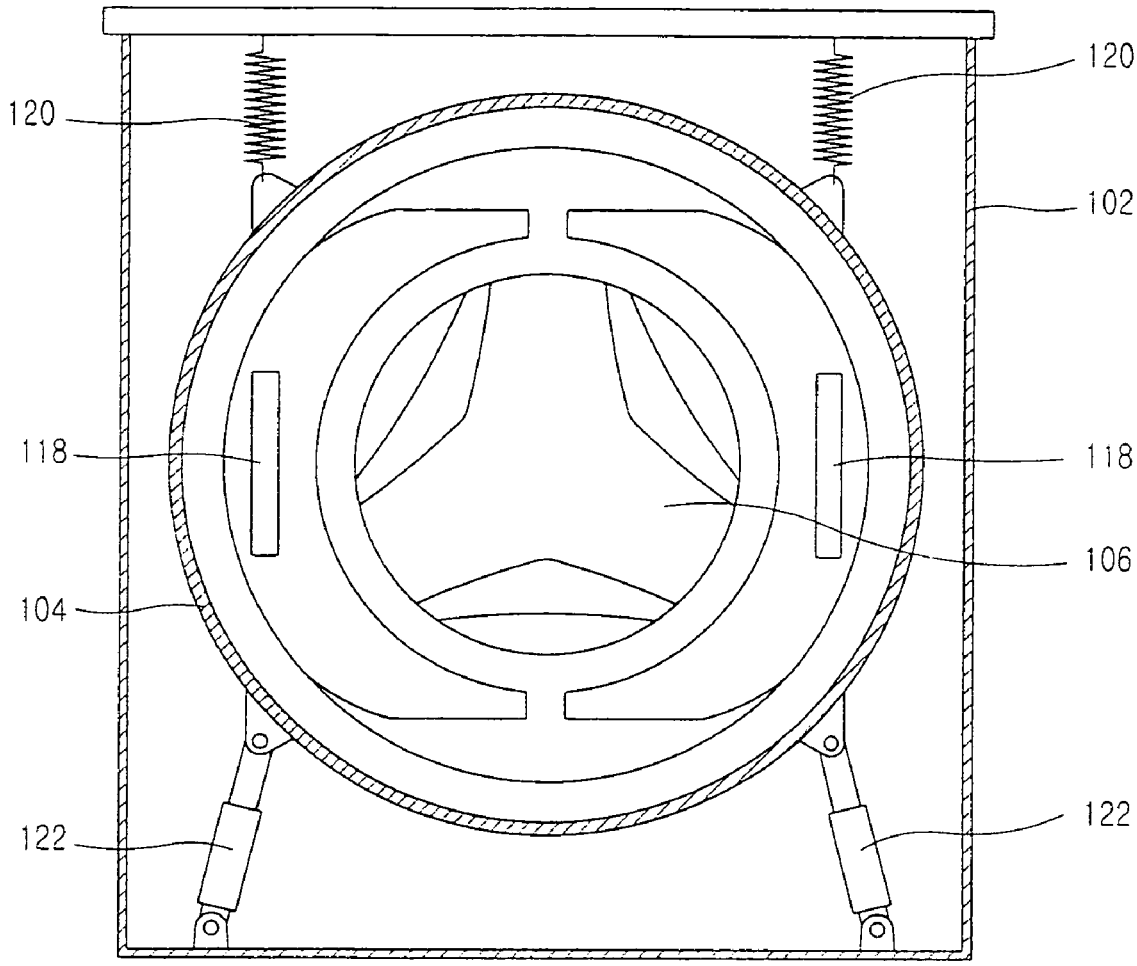
FIG. 2 CONVENTIONAL ART
FIG. 2 is a front sectional view showing the drum type washing machine in accordance with the conventional art.
Figure 3:
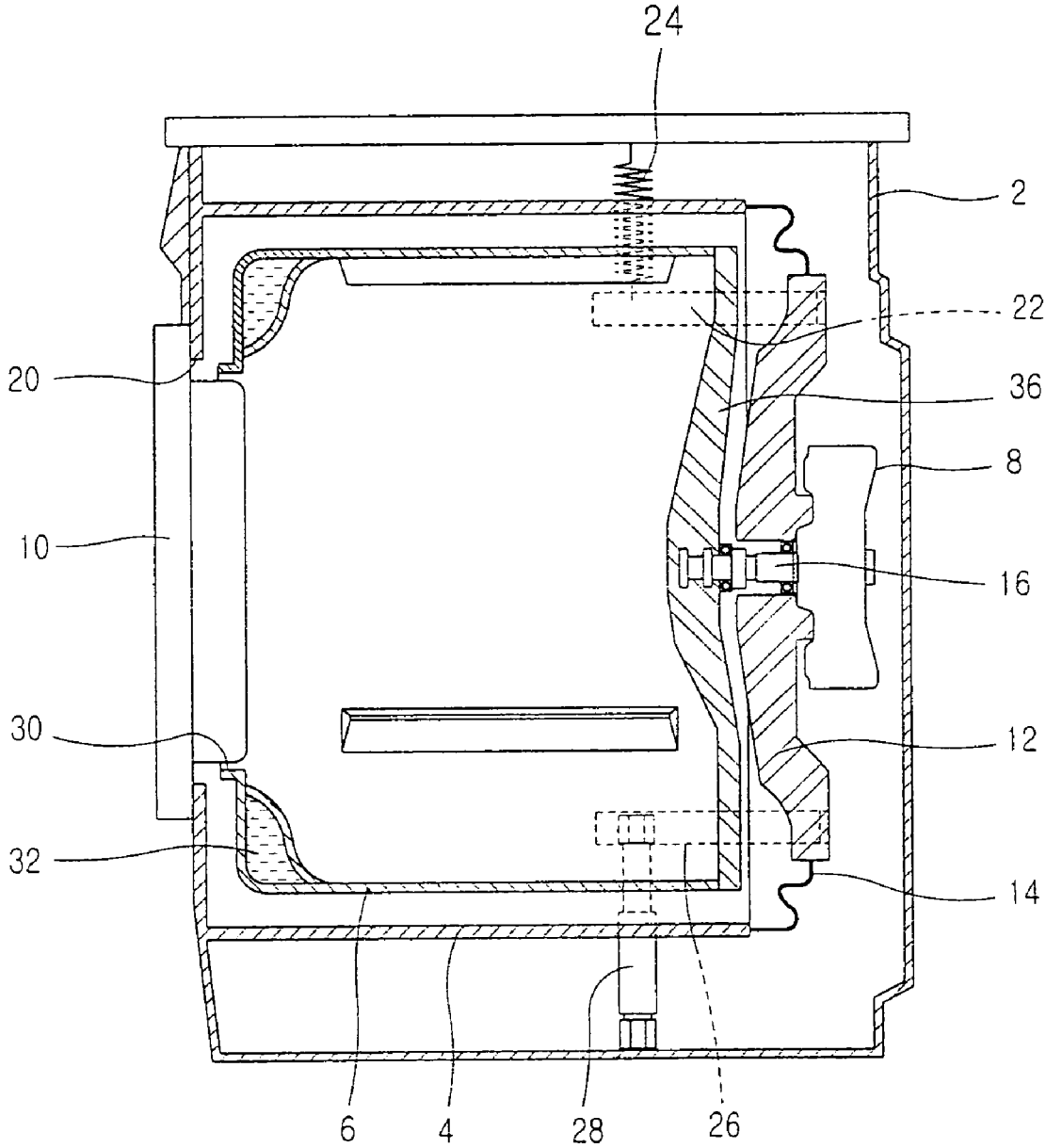
FIG. 3 is a side sectional view showing a drum type washing machine according to one embodiment of the present invention.
Figure 4:
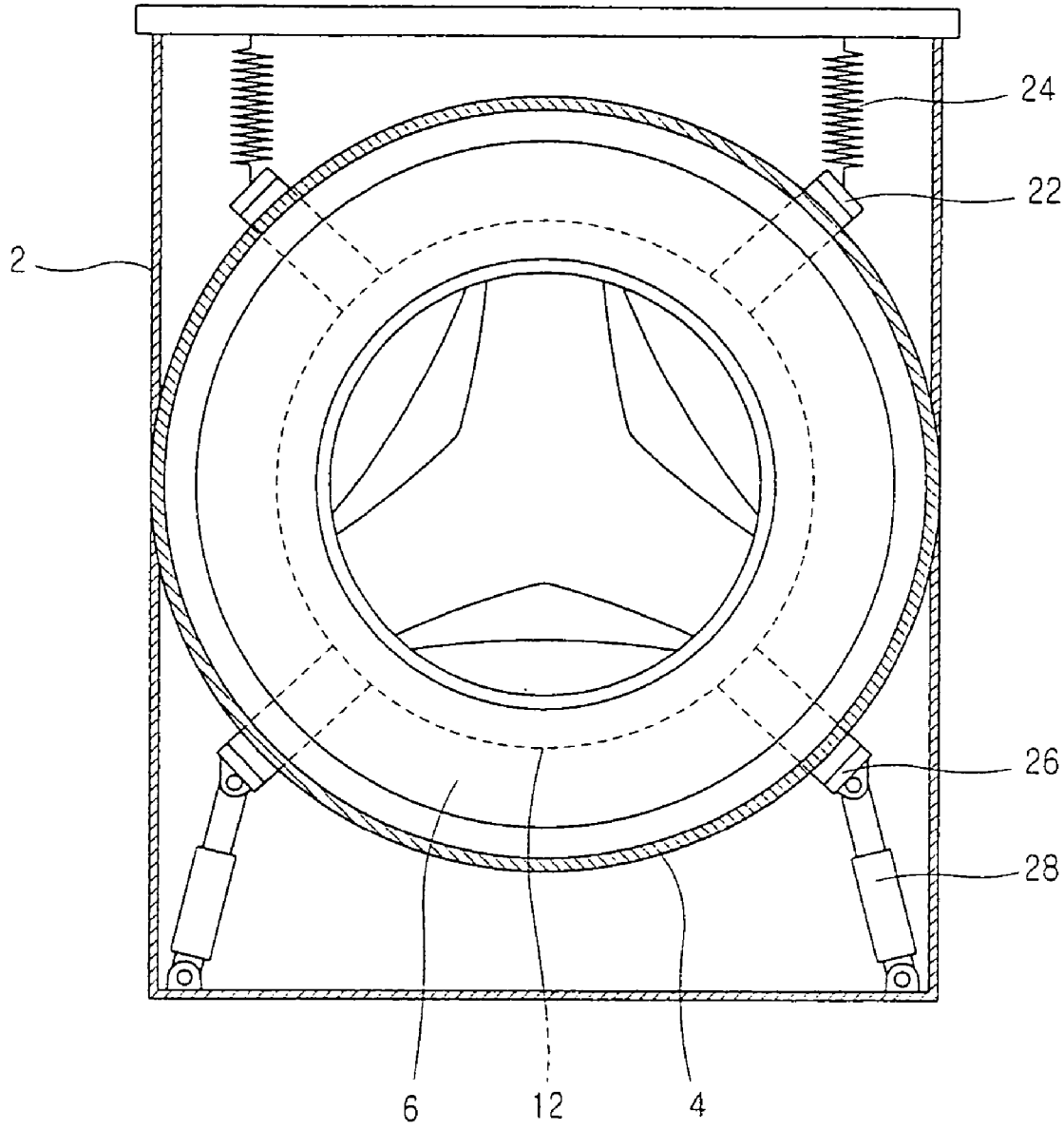
FIG. 4 is a front sectional view showing the drum type washing machine according to one embodiment of the present invention.
Figure 5:
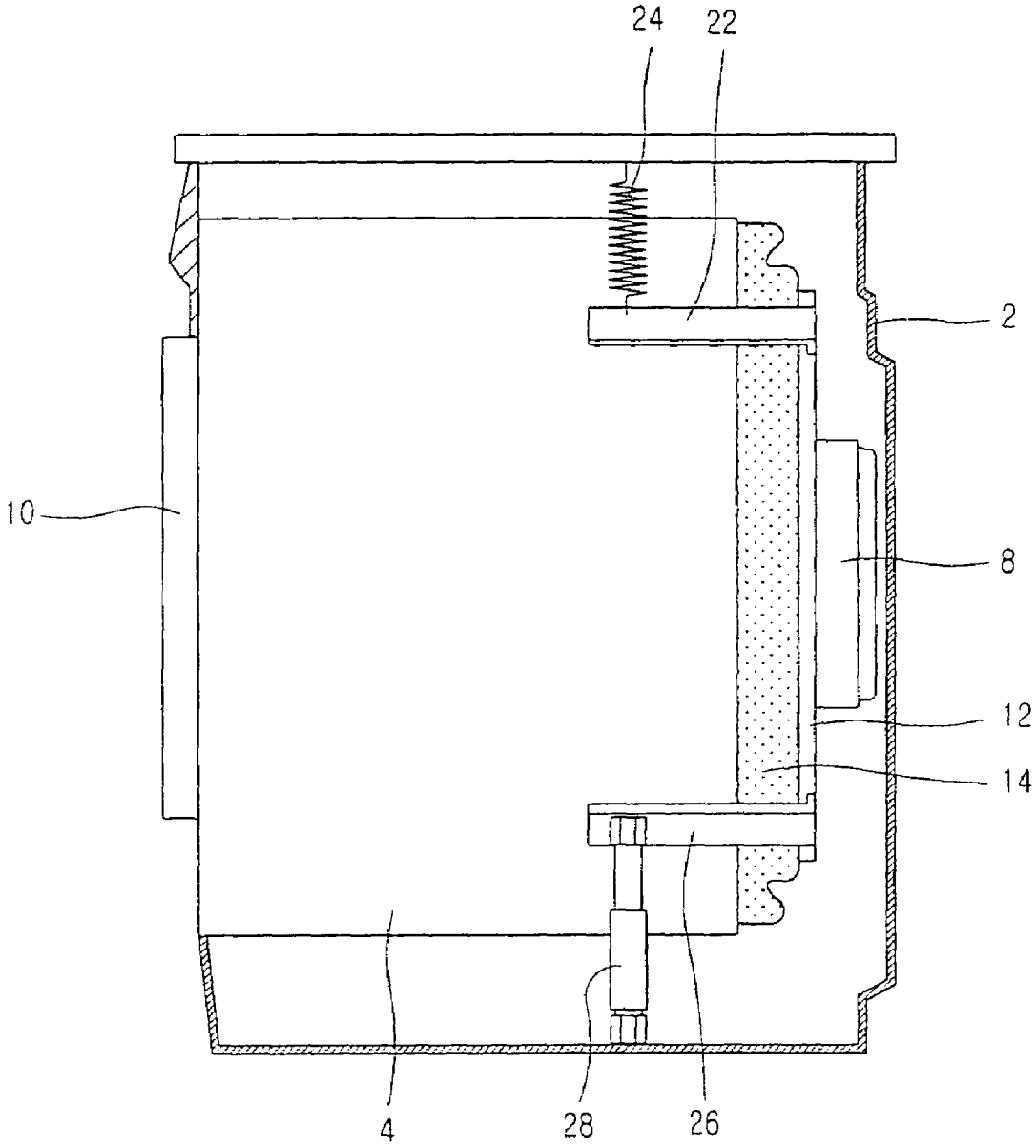
FIG. 5 is a lateral view showing a state that a casing of the drum type washing machine according to one embodiment of the present invention is cut.

FIG. 3 is a side sectional view showing a drum type washing machine according to one embodiment of the present invention, and FIG. 4 is a front sectional view showing the drum type washing machine according to one embodiment of the present invention.

The drum type washing machine according to one embodiment of the present invention comprises: a cabinet 2 for forming an appearance of a washing machine; a tub 4 formed integrally with the cabinet 2 and for storing washing water; a drum 6 rotatably arranged in the tub 4 for washing and dehydrating laundry; and a driving motor 8 positioned at the rear side of the drum 6 for generating a driving force by which the drum 6 is rotated.

The cabinet 2 is rectangular parallelepiped, and an inlet 20 for inputting and outputting laundry is formed at the front side of the cabinet 2 and a door for opening and closing the inlet is formed at the inlet 20.

The tub 4 is formed as a cylinder shape having a predetermined diameter in the cabinet 2, and the front side of the tub 4 is fixed to the front inner wall of the cabinet 2 or integrally formed at the front inner wall of the cabinet 2. Both sides of the tub 4 are contacted to both sides inner wall of the cabinet 2 or integrally formed with both sides inner wall of the cabinet 2 thus to be prolonged.

Herein, since both sides of the tub 4 are contacted to both sides inner wall of the cabinet 2, a diameter of the tub 4 can be increased.

Also, the supporting plate 12 is positioned at the rear side of the tub 4 and a sealing member (gasket) 14 is installed between the supporting plate 12 and the rear side of the tub 4, thereby preventing washing water filled in the tub 4 from being leaked.

The gasket 14 is formed as a bellows of a cylinder shape and has one side fixed to the rear side of the tub 4 and another side fixed to an outer circumference surface of the supporting plate 12.

The supporting plate 12 is formed as a disc shape, the driving motor 8 is fixed to the rear surface thereof, and a rotation shaft 16 for transmitting a rotation force of the driving motor 8 to the drum 6 is rotatably supported by the supporting plate 12. Also, a supporting unit for supporting the drum 6 with buffering is installed between the supporting plate 12 and the inner wall of the cabinet 2.

The supporting unit comprises: a plurality of upper supporting rods 22 connected to an upper side of the supporting plate 12 and having a predetermined length; buffering springs 24 connected between the upper supporting rods 22 and an upper inner wall of the cabinet 2 for buffering; a plurality of lower supporting rods 26 connected to a lower side of the supporting plate 12 and having a predetermined length; and dampers 28 connected between the lower supporting rods 26 and a lower inner wall of the cabinet 2 for absorbing vibration.

Herein, the buffering springs 24 and the dampers 28 are installed at a center of gravity of an assembly composed of the drum 6, the supporting plate 12, and the driving motor 8. That is, the upper and lower supporting rods 22 and 26 are prolonged from the supporting plate 12 to the center of gravity of the assembly, the buffering springs 24 are connected between an end portion of the upper supporting rod 22 and the upper inner wall of the cabinet 2, and the dampers 28 are connected between an end portion of the lower supporting rod 26 and the lower inner wall of the cabinet 2, thereby supporting the drum 6 at the center of gravity.

A diameter of the drum 6 is installed in a range that the drum 6 is not contacted to the tub 4 even when the drum 6 generates maximum vibration in order to prevent interference with the tub 4 at the time of being rotated in the tub 4.

Operations of the drum type washing machine according to the present invention are as follows.

If the laundry is inputted into the drum 6 and a power switch is turned on, washing water is introduced into the tub 6. At this time, the front side of the tub 6 is fixed to the cabinet 2 and the gasket 14 is connected between the rear side of the tub 6 and the supporting plate 12, thereby preventing the washing water introduced into the tub 6 from being leaked outwardly.

If the introduction of the washing water is completed, the driving motor 8 mounted at the rear side of the supporting plate 12 is driven, and the drum 6 connected with the driving motor 8 by the rotation shaft 16 is rotated, thereby performing washing and dehydration operations. At this time, the assembly composed of the drum 6, the driving motor, and the supporting plate 12 is supported by the buffering springs 24 and the dampers 28 mounted between the supporting plate 12 and the inner wall of the cabinet 20.

Figure 6:
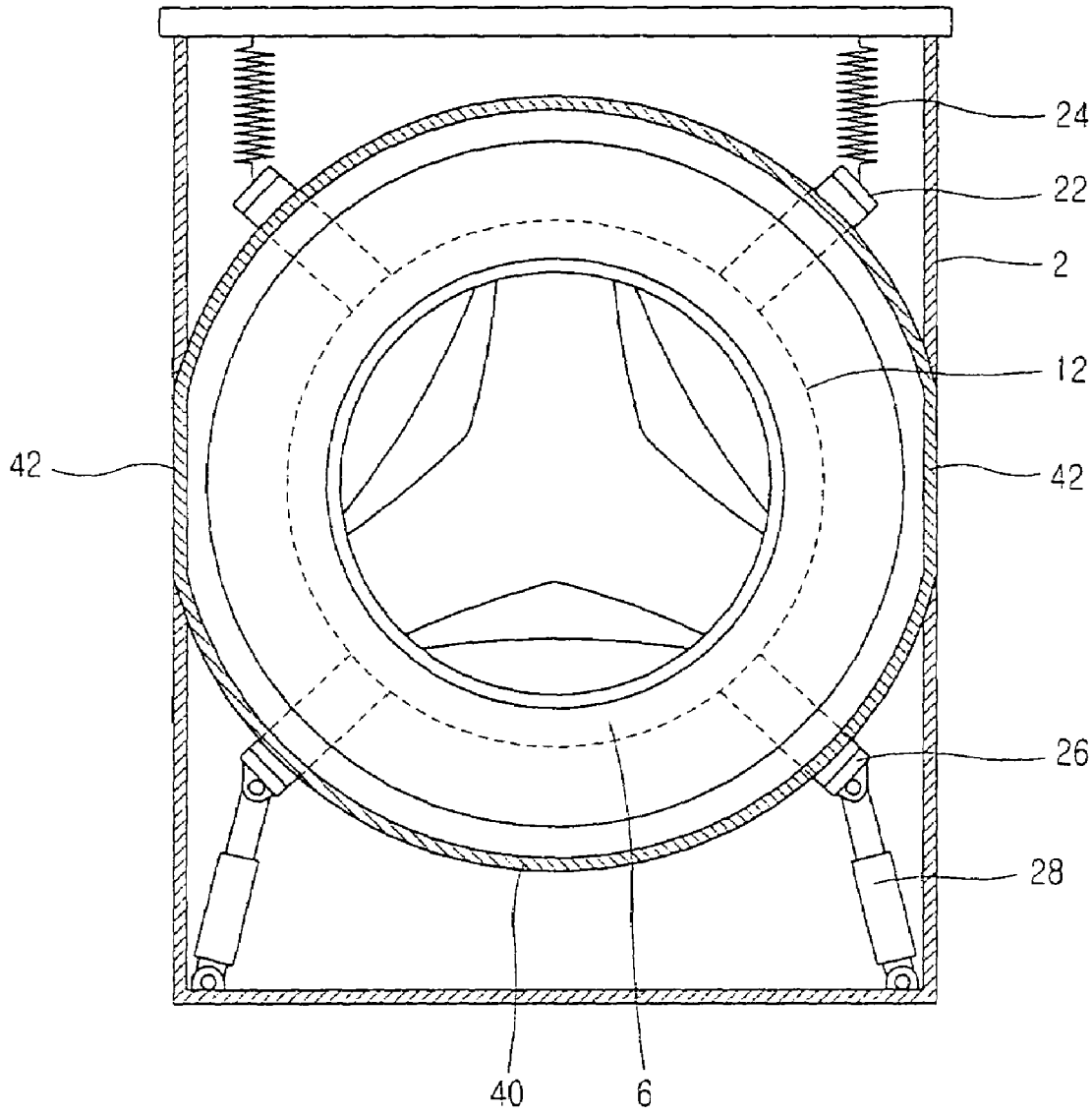
FIG. 6 is a front sectional view of a drum type washing machine according to a second embodiment of the present invention.

FIG. 6 is a front sectional view of a drum type washing machine according to a second embodiment of the present invention.

The drum type washing machine according to the second embodiment of the present invention has the same construction and operation as that of the first embodiment except a shape of the tub.

That is, the tub 40 according to the second embodiment has a straight line portion 42 with a predetermined length at both sides thereof. The straight line portion 42 is fixed to the inner wall of both sides of the cabinet 2, or integrally formed at the wall surface of both sides of the cabinet 2.

Like this, since the tub 40 according to the second embodiment has both sides fixed to the cabinet 2 as a straight line form, the diameter of the tub 40 can be increased. Accordingly, the diameter of the drum 6 arranged in the tub 40 can be more increased.

Figure 7:
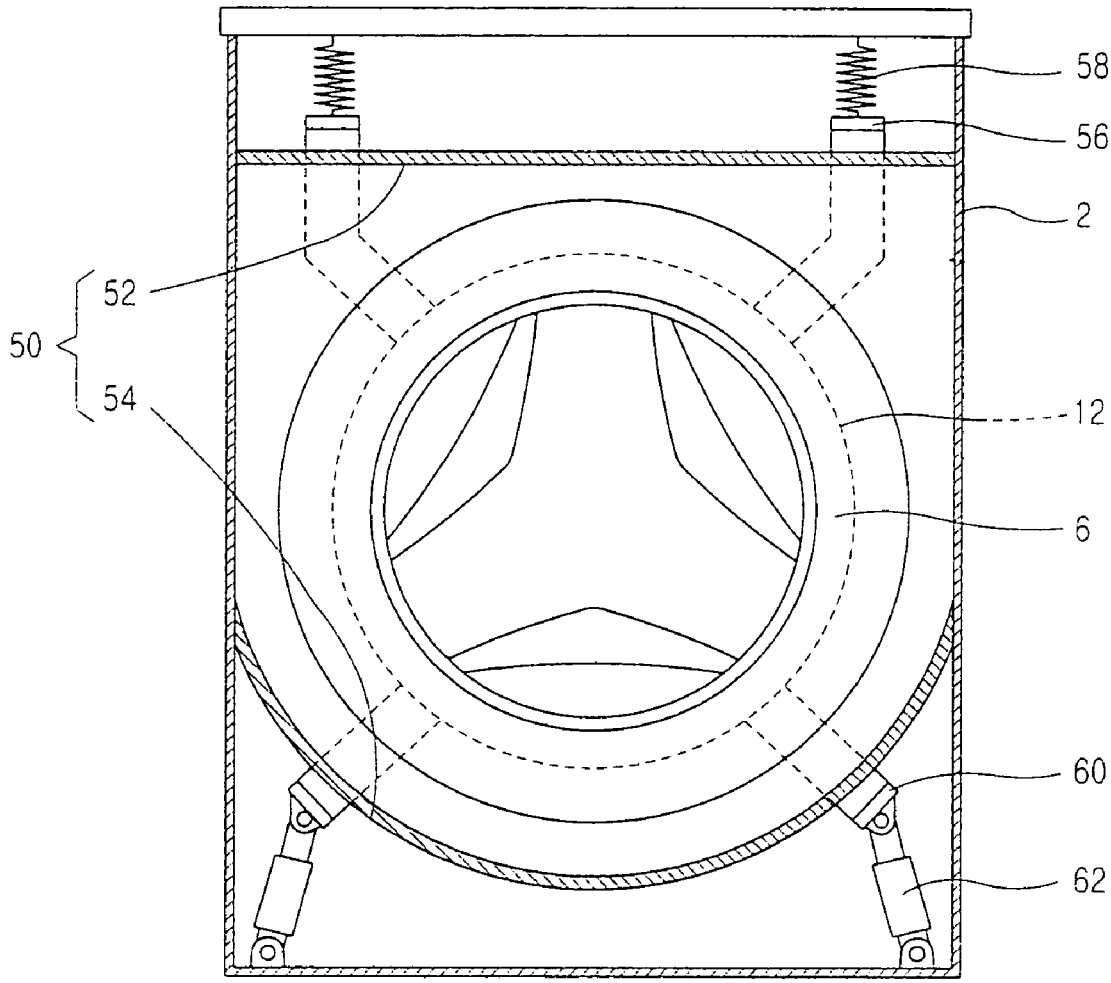
FIG. 7 is a front sectional view showing a drum type washing machine according to a third embodiment of the present invention.
Figure 8:
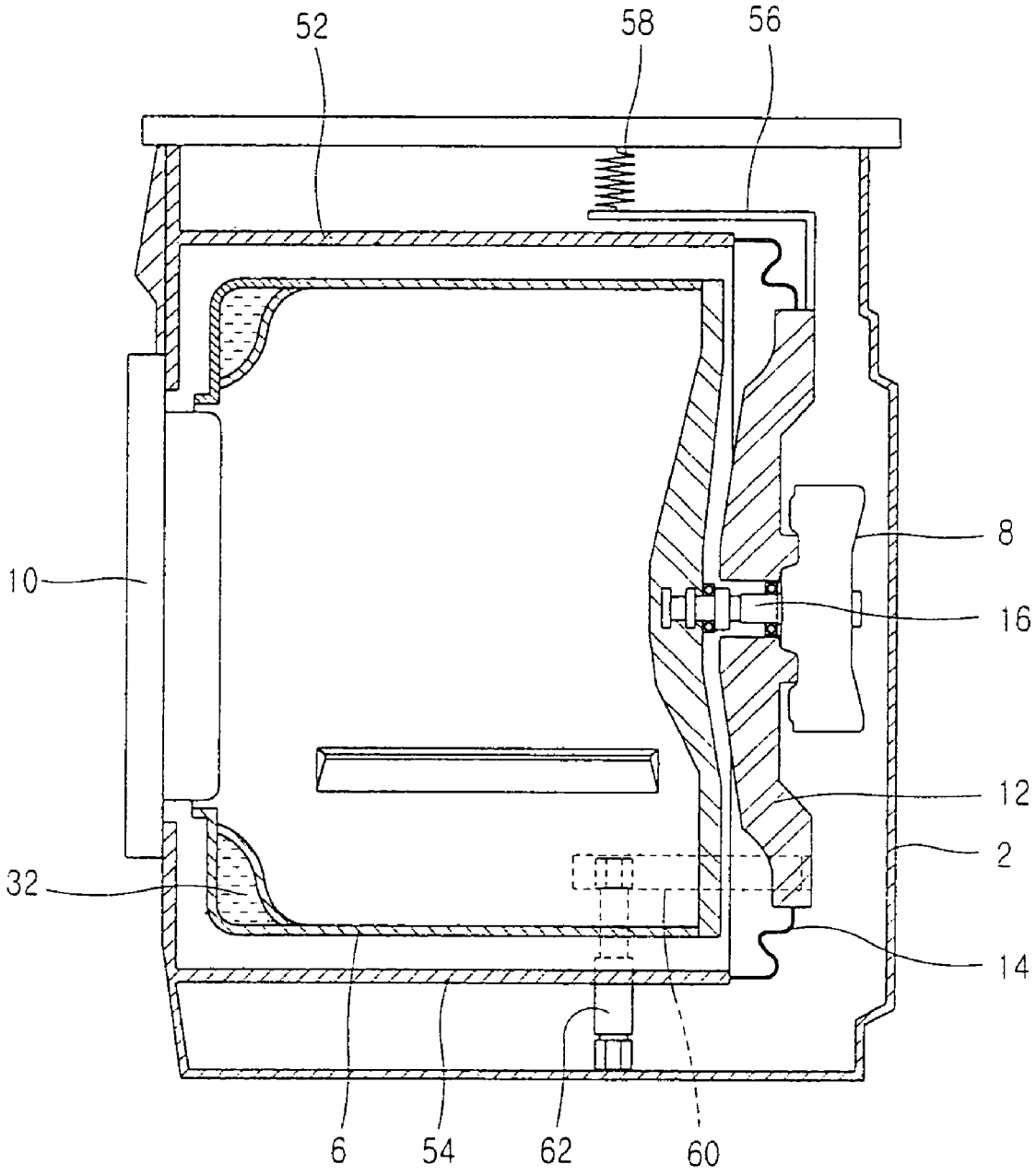
FIG. 8 is a longitudinal sectional view of the drum type washing machine according to the third embodiment of the present invention.
Figure 9:
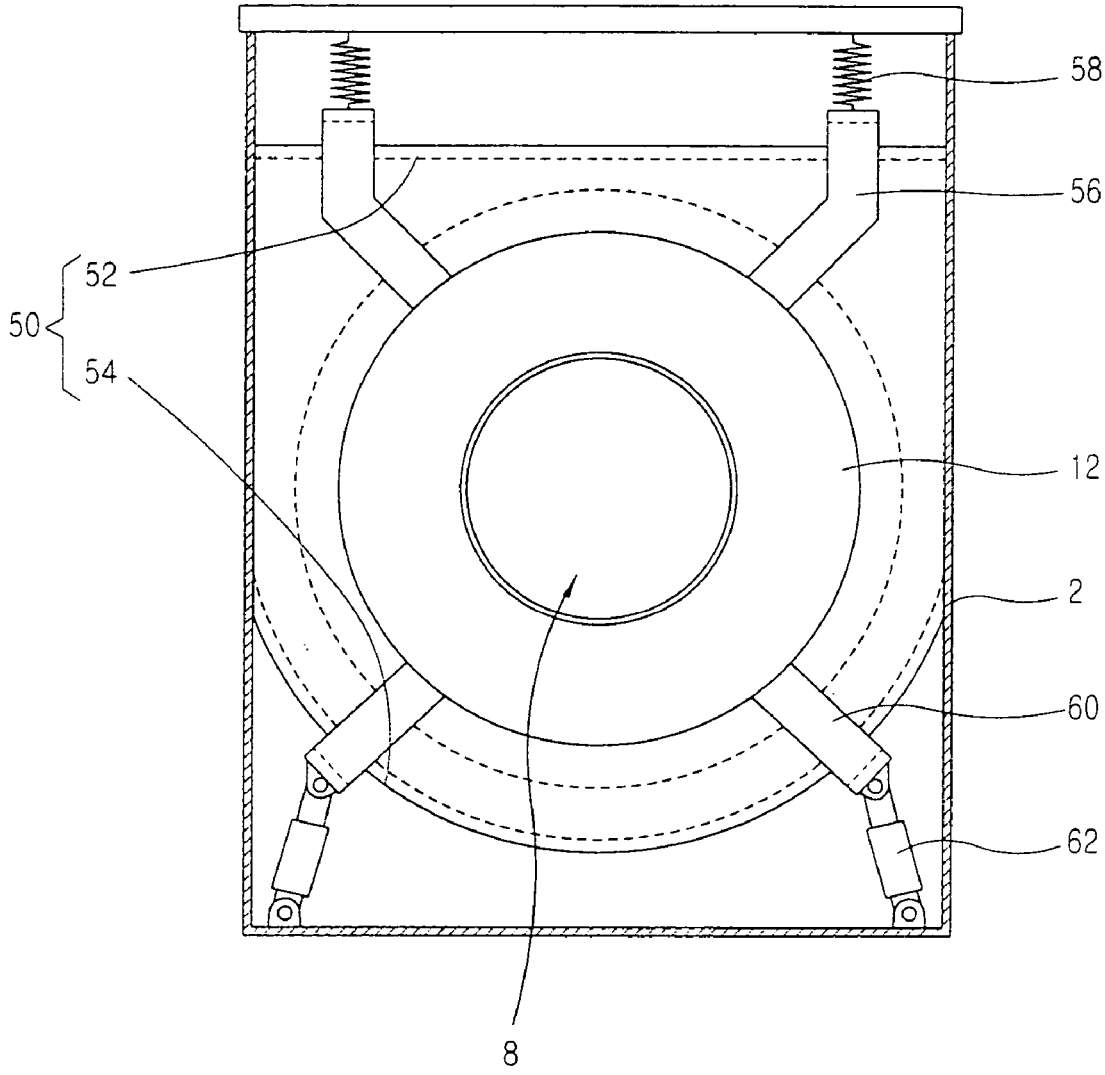
FIG. 9 is a rear sectional view showing the drum type washing machine according to the third embodiment of the present invention.

FIG. 7 is a front sectional view showing a drum type washing machine according to a third embodiment of the present invention, FIG. 8 is a longitudinal sectional view of the drum type washing machine according to the third embodiment of the present invention, and FIG. 9 is a rear sectional view showing the drum type washing machine according to the third embodiment of the present invention.

The drum type washing machine according to the third embodiment of the present invention comprises: a cabinet 2 for forming an appearance of a washing machine; a tub 50 formed integrally with the cabinet 2 and for storing washing water; a drum 6 rotatably arranged in the tub 50 for washing and dehydrating laundry; and a supporting unit positioned at the rear side of the tub 50 and arranged between the supporting plate 12 to which the driving motor 8 is fixed and the cabinet 2 for supporting the drum 6 with buffering.

The tub 50 is composed of a first partition wall 52 fixed to the upper front inner wall and both sides inner wall of the cabinet 2; and a second partition wall 54 integrally fixed to the lower front inner wall and both sides inner wall of the cabinet 2.

The first partition wall 52 of a flat plate shape is formed at the upper side of the cabinet 2 in a state that the front side and both sides are integrally formed at the inner wall of the cabinet 2 or fixed thereto. Also, the second partition wall 54 of a semi-circle shape is formed at the lower side of the cabinet 2 in a state that the front side and both sides are integrally formed at the inner wall of the cabinet 2 or fixed thereto.

The supporting unit comprises: a plurality of upper supporting rods 56 connected to the upper side of the supporting plate 12 and having a predetermined length; buffering springs 58 connected between the upper supporting rods 56 and the upper inner wall of the cabinet 2 for buffering; a plurality of lower supporting rods 60 connected to the lower side of the supporting plate 12 and having a predetermined length; and dampers 62 connected between the lower supporting rods 60 and the lower inner wall of the cabinet 2 for absorbing vibration.

Herein, the upper supporting rods 56 are bent to be connected to the upper side of the supporting plate 12 and positioned at the upper side of the first partition wall 52, and the buffering springs 58 are connected to the end portion of the upper supporting rods 56. Also, the lower supporting rods 60 are bent to be connected to the lower side of the supporting plate 12 and positioned at the lower side of the second partition wall 54, and the dampers 62 are connected to the end portion of the lower supporting rods 56.

In the drum type washing machine according to the present invention, a size of the drum can be maximized by fixing the tub in the cabinet, thereby increasing washing capacity of the drum without increasing a size of the cabinet.

Also, since the front surface of the tub is integrally formed at the inner wall of the cabinet and the gasket is installed between the rear surface of the tub and the supporting plate, a length of the drum can be increased and thus the washing capacity of the drum can be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A washing machine comprising:
a cabinet;
a tub in the cabinet for storing wash water;
a drum disposed in the tub for accommodating laundry;
a rotational shaft for transmitting a rotational force of a motor to the drum;
a supporting plate for rotatably supporting the rotational shaft;
an upper supporting rod connected to an upper portion of the supporting plate;
a spring connected between the upper supporting rod and the cabinet; and
a gasket configured to connect the tub and the supporting plate,
wherein the supporting plate is not rigid with the tub and is adapted to move relative to the tub.

2. The washing machine of claim 1, further comprising:
another upper supporting rod connected to an upper portion of the supporting plate and another spring connected to said another upper supporting rod.

3. The washing machine of claim 2, wherein the upper supporting rods extend forward.

4. The washing machine of claim 3, wherein the springs are positioned in front of a back side of the drum.

5. The washing machine of claim 2, wherein a center line of the drum is positioned between the dampers.

6. The washing machine of claim 1, wherein the motor is mounted on the supporting plate.

7. The washing machine of claim 1, wherein the drum includes an access opening provided at a front side of the drum, and wherein the rotational shaft is connected to a back side of the drum.

8. The washing machine of claim 1, wherein the tub is formed integrally with a cabinet of the washing machine.

9. The washing machine of claim 1, wherein the gasket is a corrugated gasket.

10. A washing machine comprising:
a cabinet;
a tub in the cabinet for storing wash water;
a drum disposed in the tub for accommodating laundry;
a rotational shaft for transmitting a rotational force of a motor to the drum;
a supporting plate for rotatably supporting the rotational shaft;
a lower supporting rod connected to a lower portion of the supporting plate;
a damper connected between the lower supporting rod and the cabinet; and
a gasket configured to connect the tub and the supporting plate,
wherein the supporting plate is not rigid with the tub and is adapted to move relative to the tub.

11. The washing machine of claim 10, further comprising:
another lower supporting rod connected to a lower portion of the supporting plate and another damper connected to said another lower supporting rod.

12. The washing machine of claim 11, wherein the lower supporting rods extend forward.

13. The washing machine of claim 12, wherein the dampers are positioned in front of a back side of the drum.

14. The washing machine of claim 11, wherein a center line of the drum is positioned between the dampers.

15. The washing machine of claim 10, wherein the motor is mounted on the supporting plate.

16. The washing machine of claim 10, wherein the drum includes an access opening provided at a front side of the drum, and wherein the rotational shaft is connected to a back side of the drum.

17. The washing machine of claim 10, wherein the tub is formed integrally with a cabinet of the washing machine.

18. The washing machine of claim 10, wherein the gasket is a corrugated gasket connected to the tub and the supporting plate.

19. A washing machine comprising:

a cabinet having a front side with an opening;

a tub in the cabinet for storing wash water;

a drum disposed in the tub for accommodating laundry;

a rotational shaft for transmitting a rotational force of a motor to the drum;

a supporting plate for rotatably supporting the rotational shaft;

means for flexibly connecting the tub and the supporting plate;

a rod connected to the supporting plate, the rod extending toward the front side; and means for supporting the rod to dampen the vibration transmitted to the tub.

20. The washing machine of claim 19, wherein the connecting means forms a portion of a surface facing with the back side of the drum.

21. The washing machine of claim 19, wherein the connecting means has one end portion fixed at the tub, the other end portion fixed at the supporting plate and a middle portion deformable by the movement of the support plate.

22. The washing machine of claim 19, wherein the connecting means is positioned offset from the inner surface of the tub in a radial direction of the tub.

23. The washing machine of claim 19, wherein the supporting means has at least one spring and at least one damper.

24. The washing machine of claim 19, wherein the rod has a portion extending in a radial direction of the tub and a portion extending in an axial direction of the tub.

25. The washing machine of claim 19, further comprising another rod connected to the supporting plate, wherein a center line of the drum is positioned between the rods.

26. A washing machine comprising:

a tub for storing wash water;

a drum disposed in the tub for accommodating laundry;

a rotational shaft for transmitting a rotational force of a motor to the drum;

a supporting plate for rotatably supporting the rotational shaft;

a gasket configured to connect the tub and the supporting plate and form a portion of a surface facing toward a back side of the drum;

a rod connected to the supporting plate, the rod having a portion extending in an axial direction of the tub; and a supporting unit to support the rod to dampen a vibration of the supporting plate and the drum.

27. The washing machine of claim 26, wherein the gasket has one end portion fixed at the tub, the other end portion fixed at the supporting plate, and a middle portion deformable by the movement of the support plate.

28. The washing machine of claim 26, wherein the gasket is positioned offset from an inner surface of the tub in a radial direction of the tub.

29. The washing machine of claim 26, wherein the gasket is positioned offset from the end portion of the tub in an axial direction of the tub.

30. The washing machine of claim 26, wherein the rod further has a portion extending in a radial direction of the tub.

31. The washing machine of claim 30, wherein the supporting unit is positioned at the radially-extending portion of the rod.

32. The washing machine of claim 26, wherein the supporting unit is a spring.

33. The washing machine of claim 26, wherein the supporting unit is a damper.

* * * * *